US007533436B2

(12) United States Patent
Vaartjes et al.

(10) Patent No.: US 7,533,436 B2
(45) Date of Patent: May 19, 2009

(54) MULTIFUNCTION CLEANING DEVICE FOR LARGE VEHICLES SUCH AS RECREATIONAL VEHICLES AND TRUCKS

(76) Inventors: Kornelis Vaartjes, 205 Marysville Rd., North East, MD (US) 21901; Margaret Carrol Vaartjes, 205 Marysville Rd., North East, MD (US) 21901

( * ) Notice: Subject to any disclaimer, the term of this patent is extended or adjusted under 35 U.S.C. 154(b) by 0 days.

(21) Appl. No.: 11/650,823

(22) Filed: Jan. 8, 2007

(65) Prior Publication Data

US 2008/0163442 A1 Jul. 10, 2008

(51) Int. Cl.
*A47L 13/12* (2006.01)

(52) U.S. Cl. ..... 15/114; 15/117; 15/121; 15/160

(58) Field of Classification Search ..... 15/114, 15/117, 121, 159.1, 160; D4/116, 130, 132; D32/42
See application file for complete search history.

(56) References Cited

U.S. PATENT DOCUMENTS

| | | | | | |
|---|---|---|---|---|---|
| 214,548 | A | * | 4/1879 | Bovey | 15/117 |
| 556,722 | A | * | 3/1896 | Ford | 401/136 |
| D25,895 | S | * | 8/1896 | Young | D4/130 |
| 603,581 | A | * | 5/1898 | Urmston | 15/117 |
| 625,628 | A | * | 5/1899 | Wray | 401/290 |
| 987,010 | A | * | 3/1911 | O'Brien | 15/117 |
| 1,761,180 | A | | 6/1930 | Cave et al. | |
| 1,778,121 | A | | 10/1930 | Paull | |
| 1,818,917 | A | * | 8/1931 | Wolf | 15/114 |
| 1,924,386 | A | | 8/1933 | Wallenbeck | |
| 2,083,134 | A | * | 6/1937 | Wood | 15/160 |
| 2,534,086 | A | | 12/1950 | Vosbikian et al. | |
| 2,625,700 | A | | 1/1953 | Baldwin | |
| 2,658,218 | A | | 11/1953 | Carreiro | |
| 2,663,889 | A | | 12/1953 | Fuglie | |
| 2,704,375 | A | | 3/1955 | Haeusser | |
| 2,842,789 | A | | 7/1958 | Wells | |
| 3,052,910 | A | * | 9/1962 | Kushner | 401/25 |
| 3,110,052 | A | | 11/1963 | Whitman | |
| 3,115,656 | A | * | 12/1963 | McKinstry | 15/115 |
| 3,789,451 | A | | 2/1974 | Laitner | |
| 3,968,535 | A | | 7/1976 | Nichols, Jr. | |
| 4,381,575 | A | | 5/1983 | Wendt | |
| D270,971 | S | | 10/1983 | Stevens et al. | |
| 4,524,484 | A | * | 6/1985 | Graham | 16/429 |

(Continued)

FOREIGN PATENT DOCUMENTS

| | | | |
|---|---|---|---|
| DE | 3834301 | * | 4/1990 |

*Primary Examiner*—Mark Spisich
(74) *Attorney, Agent, or Firm*—RatnerPrestia

(57) ABSTRACT

A multifunction cleaning device configured to brush, scrub, and squeegee a surface is provided. The cleaning device includes an elongate handle having an axis oriented along a plane. The device also includes a brush coupled to the handle. The brush includes bristles positioned on a side of the plane. A squeegee is coupled to the handle, with the squeegee having a contact edge positioned on an opposite side of the plane. A scrubber is coupled to the handle and adjacent the squeegee. A contact surface of the scrubber is also being positioned on the opposite side of the plane. Products according to the invention may provide any of several benefits, including cleaning corners and preventing damage to surfaces such as painted surfaces in particular inside corners as seen on todays motorcoaches, RV's, large trucks (hood and fenders).

8 Claims, 9 Drawing Sheets

U.S. PATENT DOCUMENTS

| | | | | |
|---|---|---|---|---|
| 4,893,370 | A | | 1/1990 | Klotz |
| D305,963 | S | | 2/1990 | Brinker et al. |
| D307,517 | S | | 5/1990 | Mallory et al. |
| D308,139 | S | * | 5/1990 | Viner ..... D4/118 |
| 5,083,338 | A | | 1/1992 | Unger |
| D327,146 | S | | 6/1992 | Miller |
| 5,469,594 | A | | 11/1995 | Nolte |
| 5,479,673 | A | | 1/1996 | Carton |
| 5,497,530 | A | | 3/1996 | Kamm et al. |
| 5,666,685 | A | | 9/1997 | Von Grolman et al. |
| 5,809,605 | A | | 9/1998 | Gringer |
| 5,864,913 | A | | 2/1999 | Roberton et al. |
| 6,003,187 | A | | 12/1999 | Footer et al. |
| 6,058,548 | A | | 5/2000 | Footer et al. |
| 6,065,890 | A | | 5/2000 | Weitz |
| 6,092,255 | A | | 7/2000 | Kim |
| 6,148,466 | A | * | 11/2000 | Smitelli et al. ..... 15/160 |
| D439,054 | S | * | 3/2001 | Schloesser ..... D4/130 |
| 6,564,415 | B1 | | 5/2003 | Katakura et al. |
| 6,702,497 | B1 | | 3/2004 | Tien |
| 6,705,792 | B2 | | 3/2004 | Smith |
| 6,990,705 | B1 | | 1/2006 | Schouten et al. |
| 2003/0084529 | A1 | | 5/2003 | Rudd |
| 2004/0177461 | A1 | | 9/2004 | Ajluni |

* cited by examiner

MULTIFUNCTION CLEANING DEVICE FOR LARGE VEHICLES SUCH AS RECREATIONAL VEHICLES AND TRUCKS

FIELD OF THE INVENTION

The present invention relates to multifunction cleaning devices for washing, scrubbing, and drying surfaces to be cleaned and more particularly, for cleaning windows/windshields and painted/finished surfaces of vehicles, such as trucks, motor homes, and the like, and for cleaning surfaces of building structures, such as the siding and windows of residential, commercial, or industrial buildings.

BACKGROUND OF THE INVENTION

As today's modern motor homes, recreational vehicles (RV's), trucks, and the like become larger and more complex, it is often difficult to clean such vehicles without scratching or damaging their painted finishes. It has become a particular issue with RV's designed with mechanized slide out rooms that push out from the side of the RV to expand the interior living space. When such slide out rooms are expanded, additional inside corners between painted surfaces are formed which may increase the susceptibility of scratching and damaging such corner surfaces while cleaning. In addition, cleaning around the roof edges of RV's, trucks, motor homes, and the like often requires a ladder to clean the roof edges at a desirable angle. The use of a ladder while cleaning near wet surfaces, however, increases the risk of bodily harm to the user.

Accordingly, there is a need for multifunction cleaning devices that are not subject to the above limitations. The present invention addresses this need among others.

SUMMARY OF THE INVENTION

In one aspect, the invention provides a multifunction cleaning device configured to brush, scrub, and squeegee a surface. The cleaning device includes an elongate handle having an axis oriented along a plane. The device also includes a brush coupled to the handle. The brush includes bristles positioned on a side of the plane. A squeegee is also coupled to the handle. The squeegee has a contact edge positioned on an opposite side of the plane. A scrubber is coupled to the handle and adjacent the squeegee. A contact surface of the scrubber is also being positioned on the opposite side of the plane.

In another aspect, the invention provides a multifunction cleaning device that includes an elongate handle oriented along a handle axis. A brush is coupled to the handle. The brush has bristles extending proximally from the handle. A squeegee is coupled to the handle. The squeegee has a contact edge extending proximally from the handle. The squeegee also extends proximally beyond the bristles in a direction of the handle axis.

According to yet another aspect of the invention, the invention provides a multifunction cleaning device configured to brush, scrub, and squeegee a surface. The device includes an elongate handle having an axis oriented along a plane that bisects the cleaning device into two substantially symmetrical halves. The device also includes a brush coupled to the handle. The brush has bristles extending generally along the plane. A squeegee is coupled to the handle. The squeegee being adjacent the brush. The squeegee extends generally along the plane at an orientation such that the bristles are interposed between the squeegee and the handle. A scrubber is also coupled to handle. The scrubber being adjacent the squeegee. The scrubber extends generally along the plane at an orientation such that the scrubber is interposed between the squeegee and the handle.

BRIEF DESCRIPTION OF THE DRAWING

The invention is best understood from the following detailed description when read in conjunction with the accompanying drawing. The figures are for illustration purposes only and are not necessarily drawn to scale. On the contrary, the dimensions of the various features are arbitrarily expanded or reduced for clarity. Included in the drawing.

DETAILED DESCRIPTION OF THE INVENTION

Figure 1:
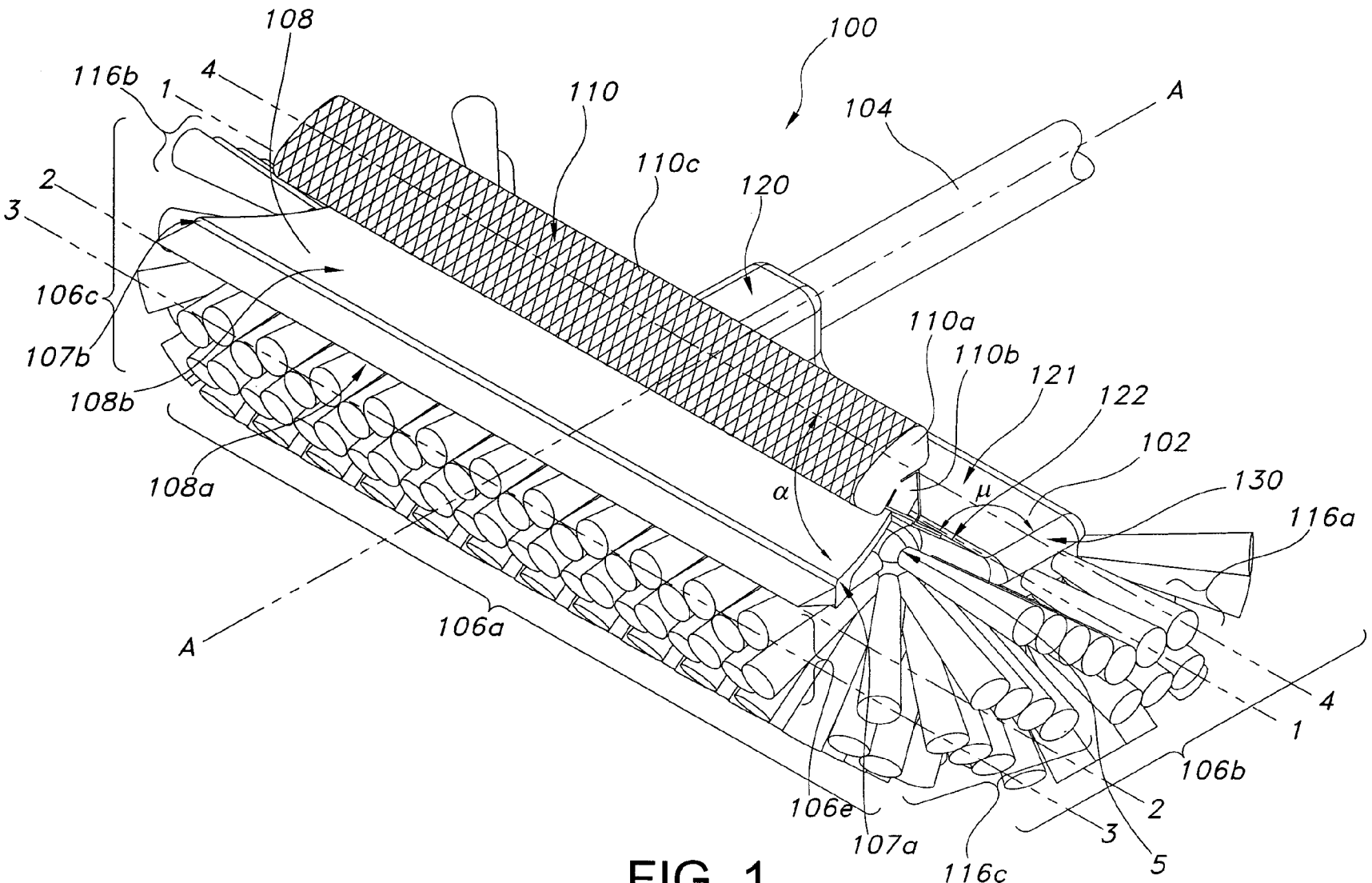
FIG. 1 is a perspective view of a cleaning device according to an exemplary embodiment of the invention.

The invention will next be illustrated with reference to the figures. Such figures are intended to be illustrative rather than limiting and are included herewith to facilitate the explanation of the present invention. The figures are not to scale, and are not intended to serve as engineering drawings. Various modifications may be made in the details within the scope and range of equivalents of the claims and without departing from the invention.

In general, and with general reference to FIGS. 1-9, a multifunction cleaning device 100 is configured to brush, scrub, and squeegee a surface. The device 100 includes an elongate handle 104 having an axis A oriented along a plane. The device 100 also includes a brush, such as brush portions 106*a*, 106*b*, 106*c*, 106*d*, and/or 106*e*, coupled to the handle 104, with the brush portion 106*a* comprising bristles positioned on a side of the plane. In an exemplary embodiment, brush portions 106*a*, 106*b*, 106*c*, 106*d*, and/or 106*e* include a bundles of bristles. Alternatively, a squeegee 108 is coupled to the handle 104, with the squeegee 108 having a contact edge 108*a* positioned on an opposite side of the plane. A scrubber 110 is coupled to the handle 104 and adjacent the squeegee 108, with a contact surface 110*f* of the scrubber 110 also being positioned on the opposite side of the plane. In an exemplary embodiment, the squeegee 108 and/or the scrubber 110 may be directly coupled to the handle 104 or may be indirectly coupled to the handle 104 via a support 102.

The brush portions 106*b*, 106*c* of the device 100 optionally includes bristles extending sidewardly from the handle 104 in a direction generally parallel to the plane. In an exemplary embodiment, bristles extending sidewardly from the handle 104 (such as bristles 116*a*, 116*b*) are key in eliminating scratching surfaces to be cleaned (described below). The brush 106*d* also optionally includes bristles oriented distally at an angle β with respect to the axis A of the handle 104. In an exemplary embodiment, the distal end of the device 100 is defined by a direction extending along axis A of the handle 104 and extending away from the contact edge 108*a* of the squeegee 108 along handle axis A. The angle β may be in a range of about 30° to about 60°. The scrubber 110 can be positioned adjacent the squeegee 108 at an angle α, wherein the angle α is optionally in a range of about 30° to about 90°. In an exemplary embodiment, angle α can be defined by the angle between the contact edge 108*a* of the squeegee 108 and an axis 4 bisecting the contact surface 110*f* of the scrubber 110. The handle 104 is optionally extendable and retractable in length along axis A.

In another exemplary aspect, the device 100 also includes a brush 106*e* coupled to the handle 104, with the brush 106*e* having bristles extending proximally from the handle 104. A squeegee 108 is coupled to the handle 104, with the squeegee 108 having a contact edge 108*a* extending proximally from the handle 104. The squeegee 108 also extends proximally beyond the bristles 106*e* in a direction of the handle axis A.

In an exemplary embodiment, the proximal end of the device 100 is defined by a direction extending along axis A of the handle 104 and extending towards the contact edge 108*a* of the squeegee 108 along the handle axis A. The contact edge 108*a* of the squeegee 108 optionally extends proximally about ¼ inch beyond the bristles of brush 106*e* in a direction of the handle axis A.

In another exemplary aspect, the multifunction cleaning device 100 includes an elongate handle 104 having an axis A oriented along a plane that bisects the cleaning device 100 into two substantially symmetrical halves. The device 100 also includes a brush, such as brush portions 106*a*, 106*b*, 106*c*, 106*d*, and/or 106*e*, coupled to the handle 104. The brush portions 106*a*, 106*b*, 106*c*, 106*d*, and/or 106*e* include bristles that extend generally along the plane. A squeegee 108 is coupled to the handle 104, with the squeegee 108 being adjacent the brush portions 106*a*, 106*b*, 106*c*, 106*d*, and/or 106*e*. The squeegee 108 also extends generally along the plane at an orientation such that the bristles are interposed between the squeegee 108 and the handle 104. A scrubber 110 is also coupled to handle 104, with the scrubber 110 being adjacent the squeegee 108. The scrubber 110 extends generally along the plane at an orientation such that the scrubber 110 is interposed between the squeegee 108 and the handle 104.

Figure 4:
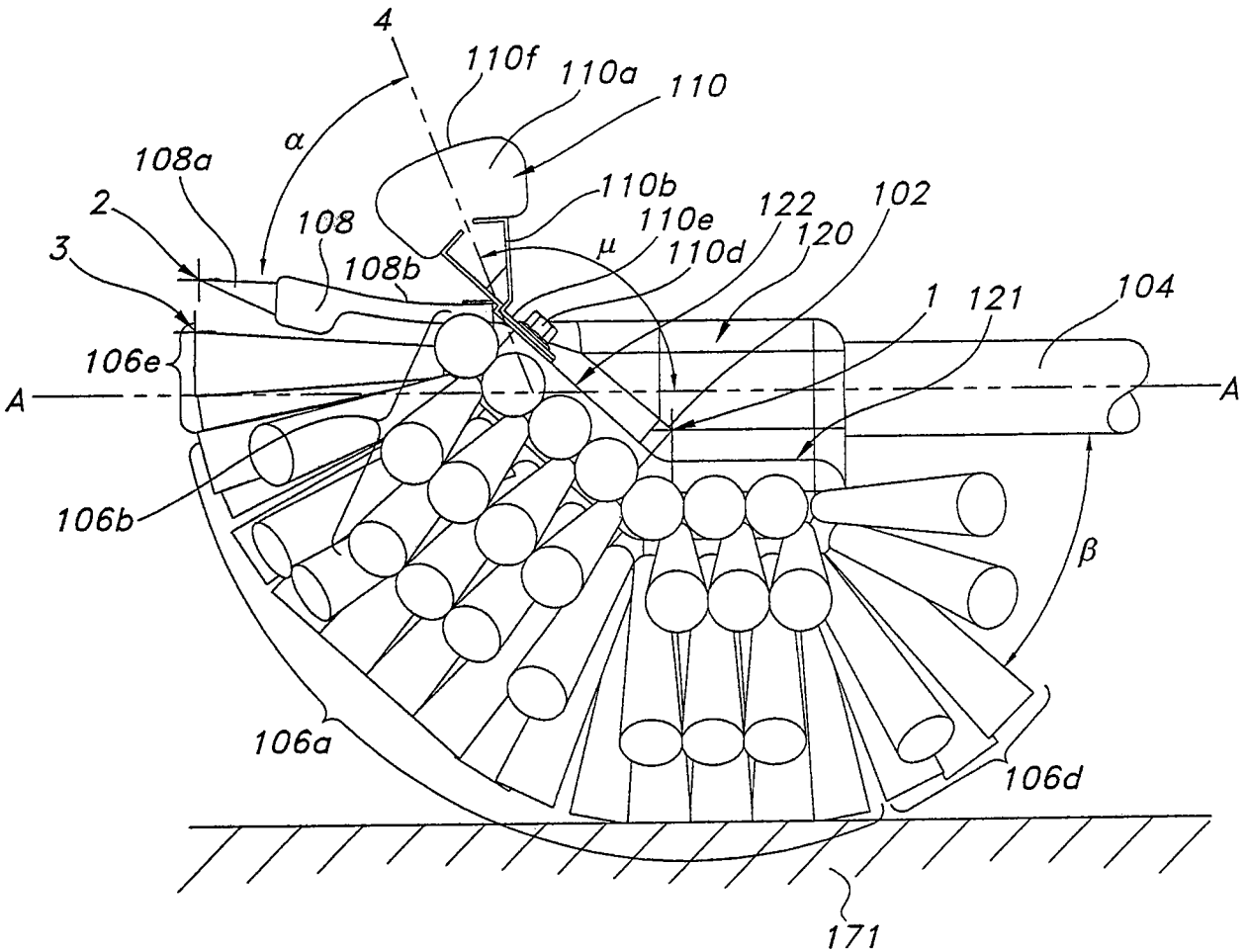
FIG. 4 is a side view of the cleaning device illustrated in FIG. 1 showing brushes cleaning a single surface.

In an exemplary aspect (FIGS. 4-6), the exemplary cleaning device 100 includes handle 104 coupled to a support 102. In a clockwise direction with respect to handle axis A as shown in FIG. 4 (counter clockwise in FIGS. 5 and 6 because of the orientation of the view), the device 100 includes brush 106*d* which extends distally towards handle 104 at an angle β. In a clockwise direction from brush portion 106*d* (shown in FIG. 4), the device 100 includes brush portions 106*a*, 106*b*, and 106*c*. Brush portions 106*b*, 106*c* are generally positioned opposite each other such that bristles extend outwardly from handle axis A in opposite directions. Brush portion 106*a* is generally positioned on device 100 such that bristles are adjacent bristles of brush portions 106*b*, 106*c*. As shown in FIG. 4, clockwise of brush portions 106*a*, 106*b*, and 106*c* is brush portion 106*e*. Brush portion 106*e* extends proximally from the handle 104 along a direction of handle axis A and is adjacent squeegee 108. The squeegee 108 has a contact edge 108*a* that extends proximally from the handle 104 and beyond bristle ends of brush portion 106*e*. In a clockwise direction from the squeegee 108 (shown in FIG. 4), the device 100 includes a scrubber 110 that is angled with respect to the squeegee 108 at angle α. Further clockwise of the scrubber 110 (shown in FIG. 4) is handle 104. In an exemplary embodiment, the scrubber 110 can be adjacent handle 104 at an angle μ that can be defined by the angle between axis 4 that bisects the contact surface 110*f* of the scrubber 110 and handle axis A.

Referring now to the drawings in detail (FIGS. 1-9), in accordance with an exemplary embodiment of the invention, a cleaning device 100 for brushing, scrubbing, and drying surfaces is provided. More specifically, a cleaning device 100 may be provided for cleaning surfaces such as painted or finished surfaces, inside and/or outside corners, and windows and/or windshields without scratching or damaging the surfaces to be cleaned.

Figure 3:
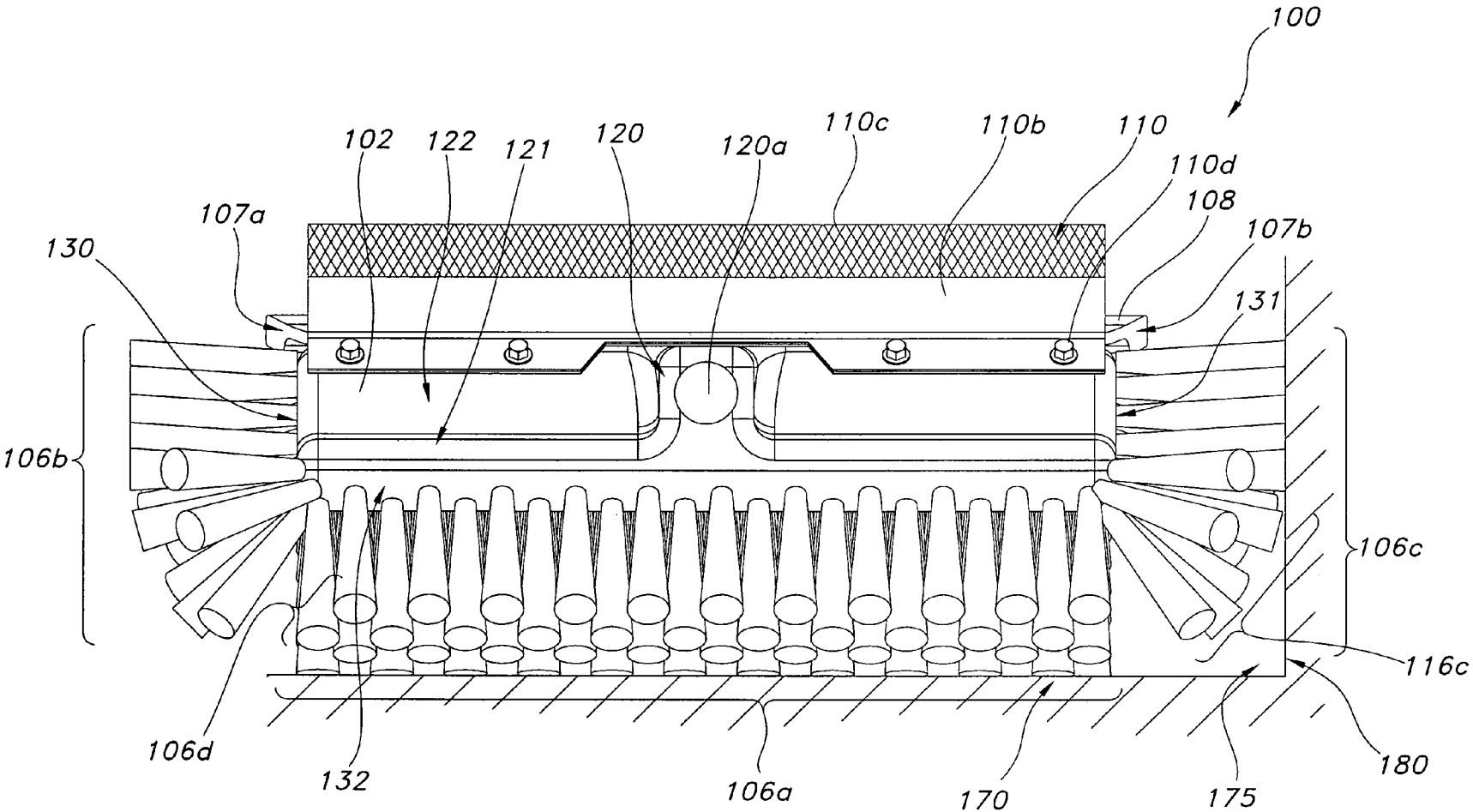
FIG. 3 is a perspective view of the cleaning device illustrated in FIG. 1 showing brushes cleaning adjacent surfaces.
Figure 7:
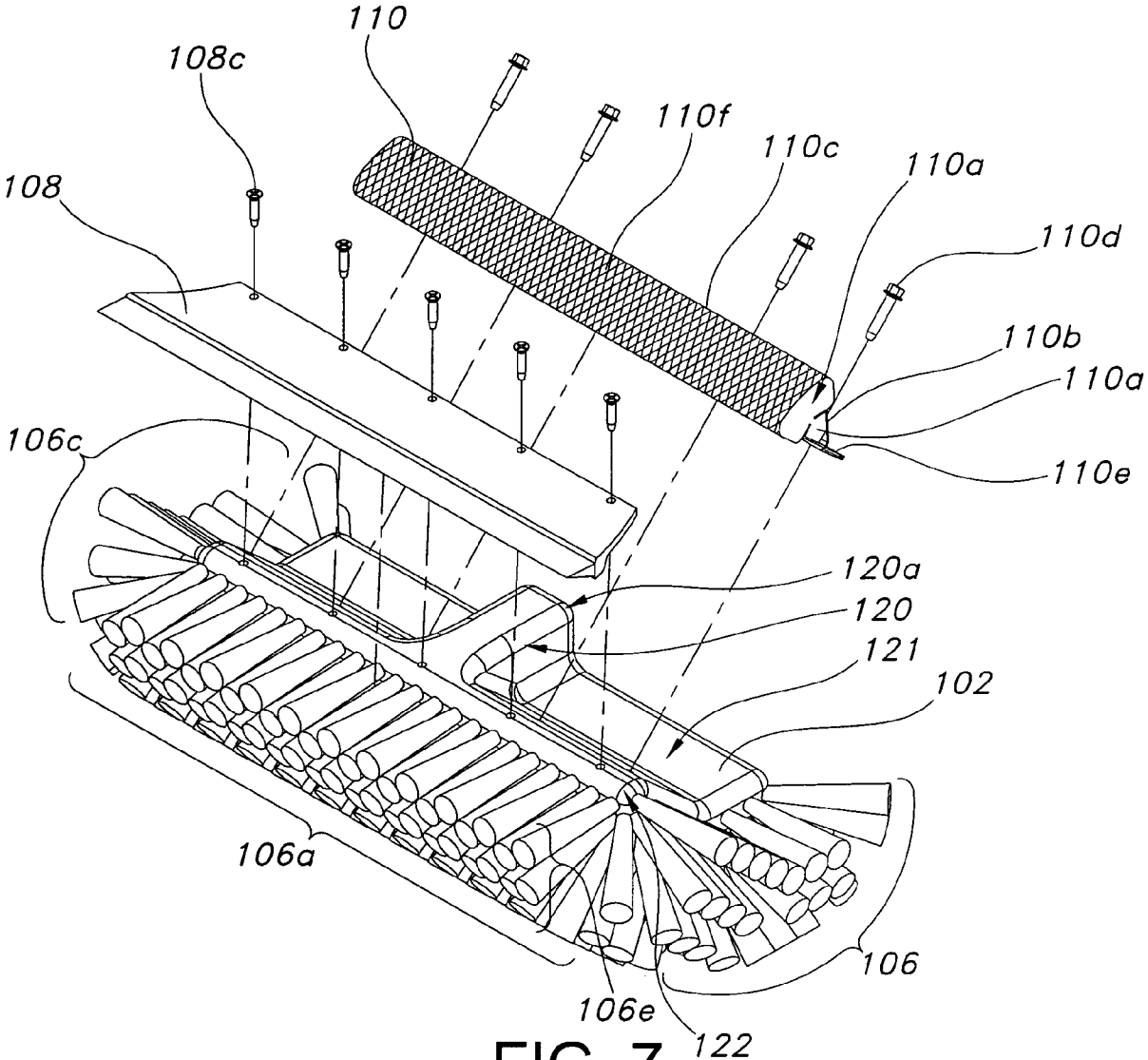
FIG. 7 is an exploded view of the cleaning device illustrated in FIG. 1.

In an exemplary embodiment, the cleaning device 100 includes a support 102 to which various components of the cleaning device 100 are coupled. The components of the cleaning device 100 include brush portions 106*a*, 106*b*, 106*c*, 106*d*, and/or 106*e*; a squeegee 108; and a scrubber 110. The squeegee 108 and the scrubber 110 may be coupled to the support 102 by screws 108*c*, 110*d* as best shown in FIG. 7. A handle 104 may also be coupled to the support 102 by a handle support 120 on the support 102. As illustrated in FIG. 3, the handle support 120 may have an opening 120*a* into which the handle 104 may be inserted. The support 102 may be a rigid structure that may be capable of supporting the components of the cleaning device 100 and may be made from various materials such wood, plastic, or metal. In an exemplary embodiment, the support 102 may be made from a lightweight material in order to provide a cleaning device 100 that may be lightweight and easily handled by a user.

Figure 5:
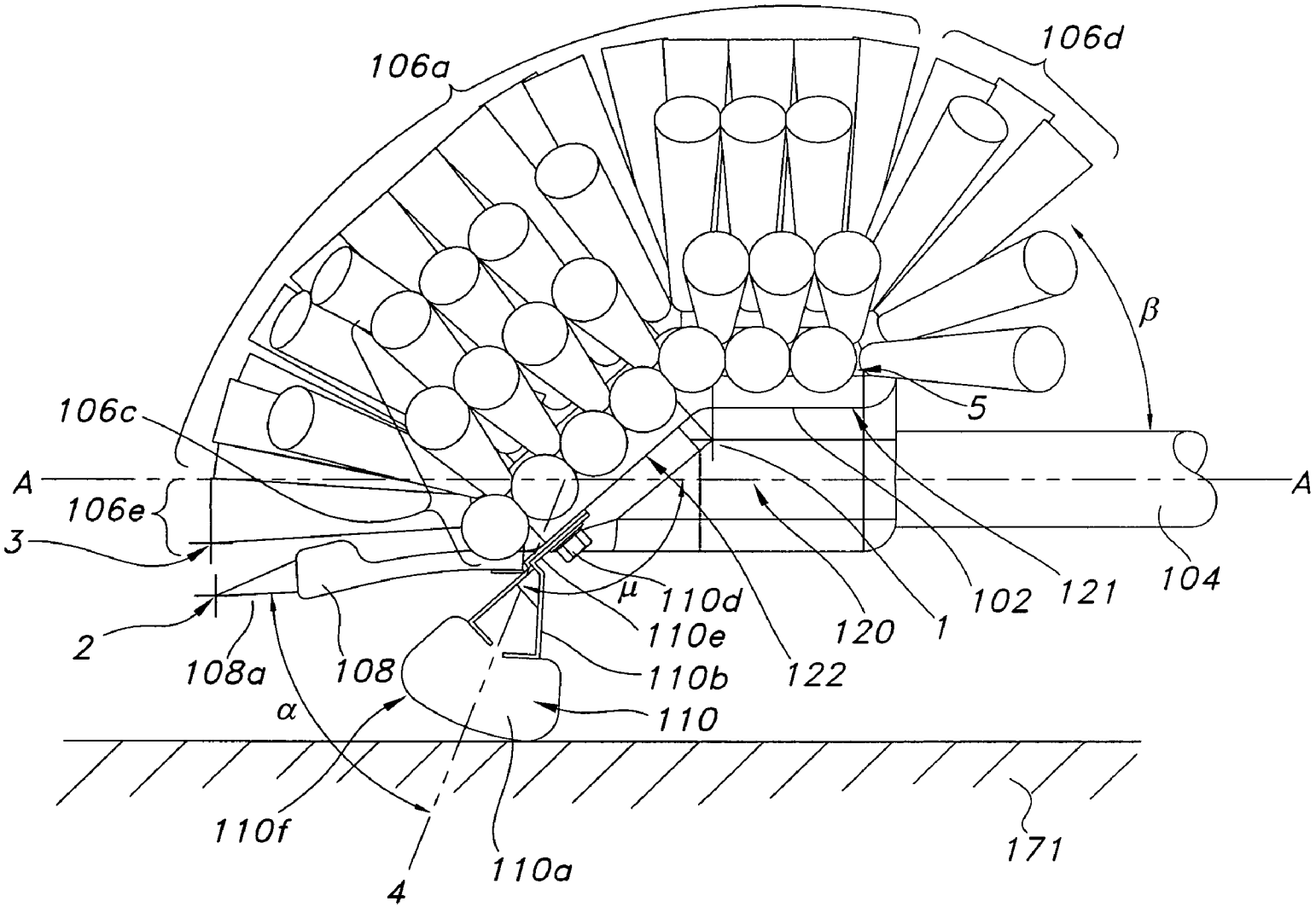
FIG. 5 is another side view of the cleaning device illustrated in FIG. 1 showing a scrubber on a surface.

FIGS. 1-6 depict an exemplary embodiment of the cleaning device 100 of the present invention. The cleaning device 100 includes the support 102 that has a substantially V-shaped body defined by two planar surfaces 121, 122. The V-shape is best shown in FIGS. 4 and 5. The two planar surfaces 121, 122 may intersect each other at an intersection axis represented through dashed line 1 shown in FIG. 1 and FIG. 4. The angle between the first planar surface 121 and the second planar surface 122 may be about 90° or greater.

Figure 2:
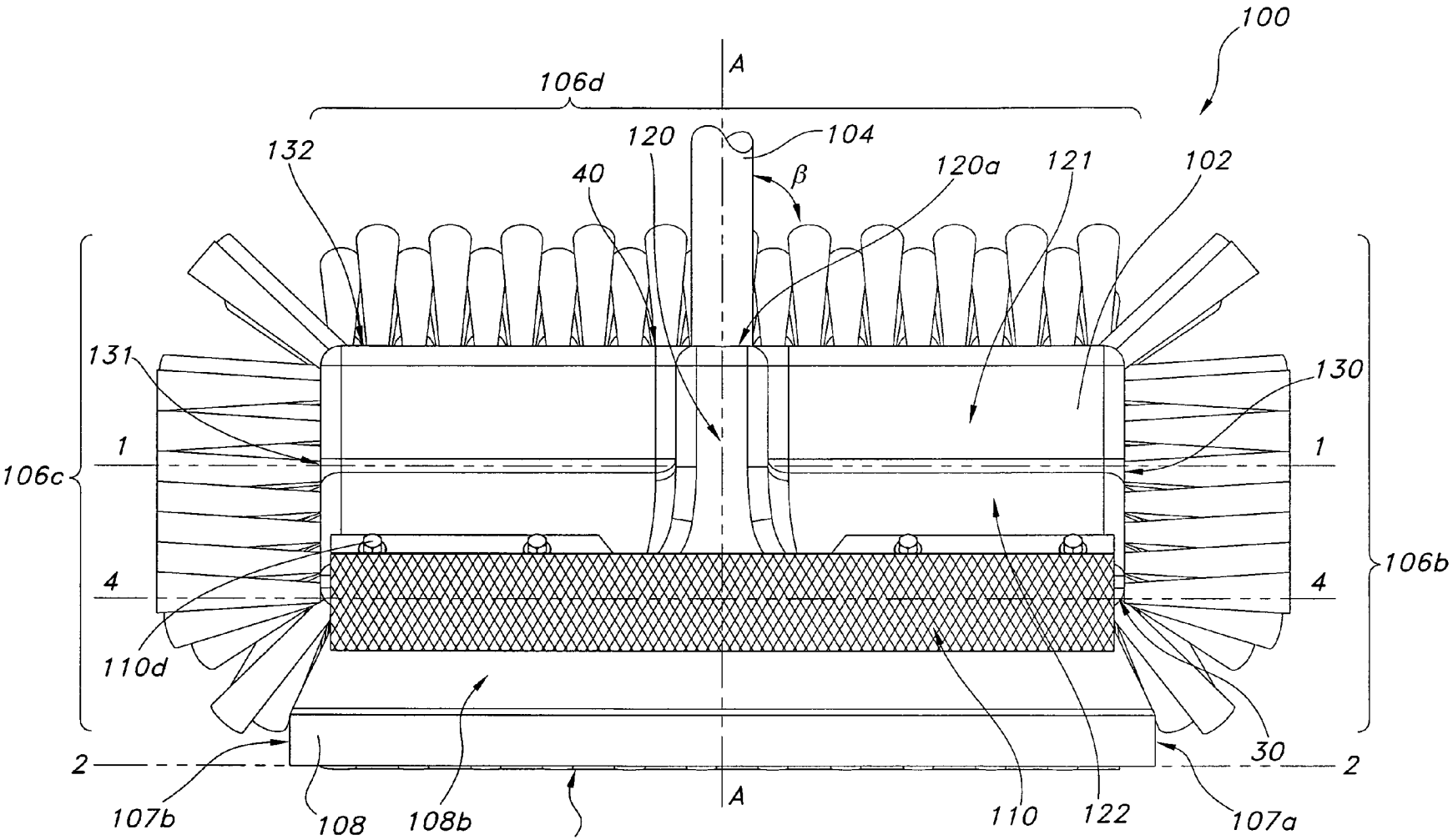
FIG. 2 is an overhead view of the cleaning device illustrated in FIG. 1.

The substantially V-shaped support 102 may be configured such that handle 104 may be coupled to one end 40 of the support 102 and the squeegee 108 and scrubber 110 may be coupled to an opposite end 30 of the support as shown in FIG. 2. More specifically, handle 104 may be coupled to the support 102 by a handle support 120 mounted on a portion of the first planar surface 121 and/or on a portion of the second planar surface 122. The squeegee 108 and scrubber 110 may be coupled to a portion of the second planar surface 122.

The handle support 120 may be configured to receive and couple a portion of the handle 104 such that handle 104 may be substantially parallel to the first planar surface 121. As shown in FIG. 3, the handle support 120 may include a recess 120*a* (which may be threaded) in which a portion of handle 104 may be inserted and secured. If recess 120*a* is threaded, the end of handle 104 which may be inserted into recess 120*a* may have complementary threads. In alternative embodiments, the handle support 120 may be positioned at an angle with respect to the first planar surface 121 at about 45° or less. Thus, when the end of handle 104 is inserted into threaded recess 120*a*, the handle 104 may be angled with respect to the first planar surface 121.

The first planar surface 121 and the second planar surface 122 of support 102 may include bottom surfaces (not shown) that couple to brush portion 106*a*. The bottom surfaces of support 102 may include a plurality of holes 5 as shown in FIG. 5 in which individual bristles of brush portion 106*a* may be inserted and secured. The bristles of brush portion 106*a* may be secured in the holes by glue or by heat sealing. Alternatively, the bottom surfaces of support 102 (not shown) may be flat surfaces to which brush portion 106*a* may be coupled. In an alternative embodiment, the brushes 106*a* may be coupled to the support 102 in another manner as long as the brushes 106*a* are securely coupled to the support 102.

Support 102 further includes side surfaces 130, 131 to which brush portions 106*b*, 106*c* may be coupled. The side surfaces 130, 131 may be parallel to each other and may be positioned at opposite ends of the support 102. The side surfaces 130, 131 may include a plurality of holes 5 (described above) or may be flat surfaces to which brush portions 106*b*, 106*c* may be coupled. Brush portions 106*b*, 106*c* may extend away from the side surfaces 130, 131 of support 102 such that brush portions 106*b*, 106*c* may act as side brushes that may prevent side surfaces 130, 131 of the support 102 and/or side edges 107*a*, 107*b* of the squeegee 108 from contacting and damaging surfaces to be cleaned.

Brush portions 106*b*, 106*c* may include side bristles 116*a*, 116*b* as depicted in FIG. 1 that may extend substantially parallel to the first planar surface 121 and the second planar surface 122. Side bristles 116*a*, 116*b* may be beneficial in preventing the scratching of corner surfaces to be cleaned. In addition, some bristles 116*c* of brush portions 106*b*, 106*c* may be tapered towards brush portion 106*a* on the bottom surfaces of the support 102 (e.g., angled on side surfaces 130, 131 towards brush portion 106*a*). In an exemplary embodiment, the brush portions 106*b*, 106*c* may be angled between a range of about 0° to about 90° with respect to brush portion 106*a*. As depicted in FIG. 3, when brush portions 106*b*, 106*c* on the sides 131, 132 of the support 102 are angled between a range of about 0° to about 90° with respect to brush portion 106*a*, a continuous brush including brush portions 106*b*, 106*c* and brush portion 106*a* may be provided.

FIG. 3 shows a bottom edge surface 132 of support 102 to which brush portion 106*d* may be coupled. Brush portion 106*d* may be adjacent brush portion 106*a* and may be positioned adjacent the handle 104 at an angle β relative to the handle 104 shown in FIGS. 4-6. In an exemplary embodiment, the bristles of brush portion 106*d* may be oriented distally towards the handle 104 at an angle β with respect to the axis A of the handle 104. Angle β may be an acute angle selected from a range of about 30° to about 60°. In an exemplary embodiment, the angle β between brush portion 106*d* and the handle 104 may be about 45°. By having brushes 106*d* at one of these angles, it may be possible to use brush portion 106*d* to at least partially clean rounded outside corners (i.e. rolled corners) or flat outside corners.

Figure 8:
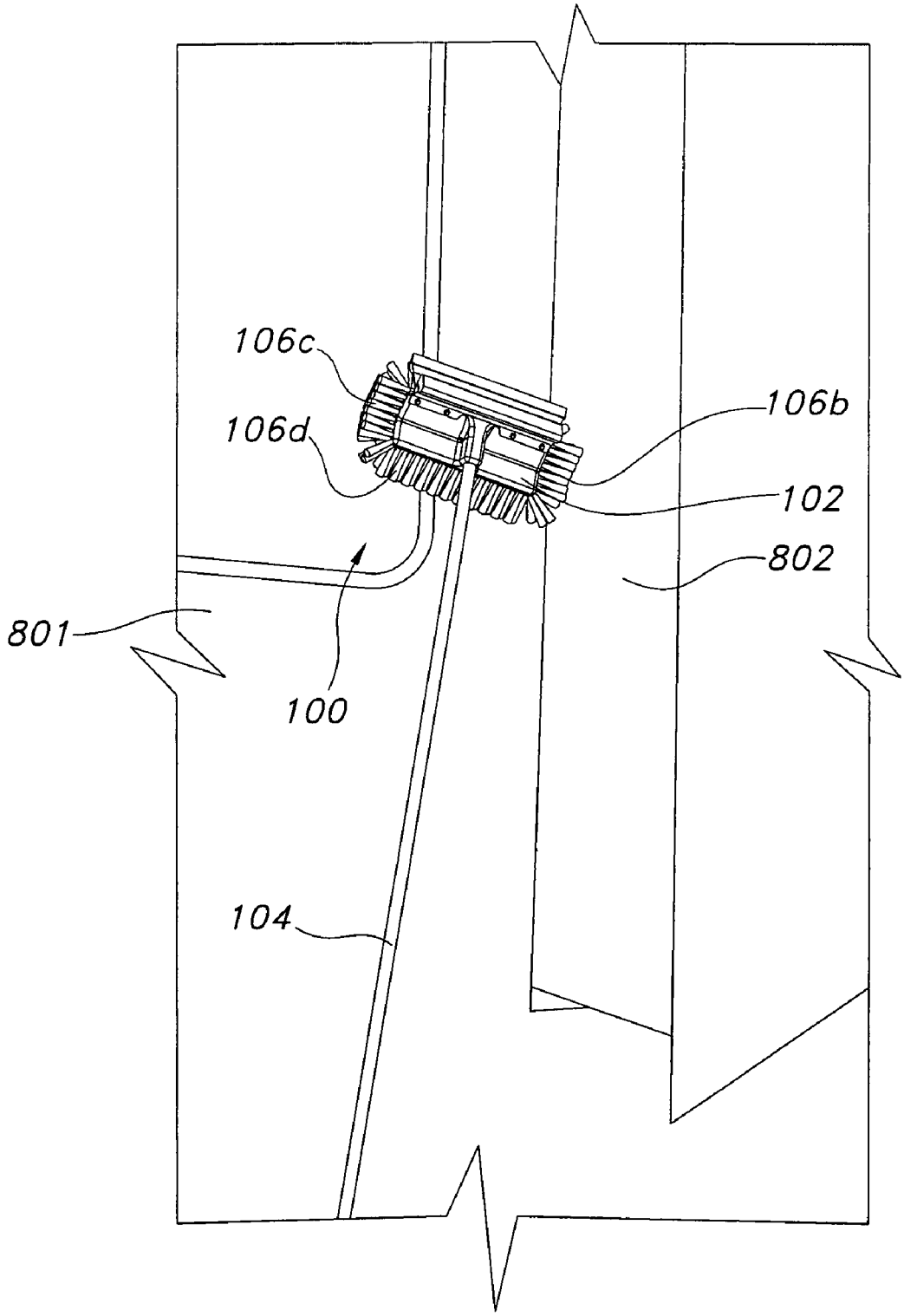
FIG. 8 illustrates the cleaning device shown in FIGS. 1-7 being used on surfaces of a recreational vehicle.

As shown in FIG. 8, a person may grab handle 104 and position the cleaning device 100 on a surface 801 to be cleaned such that brush portion 106*a* contacts the surface 801. The person may then apply an up and down, side to side, or any other motion to clean the surface 801 via brush portion 106*a*.

Figure 9:
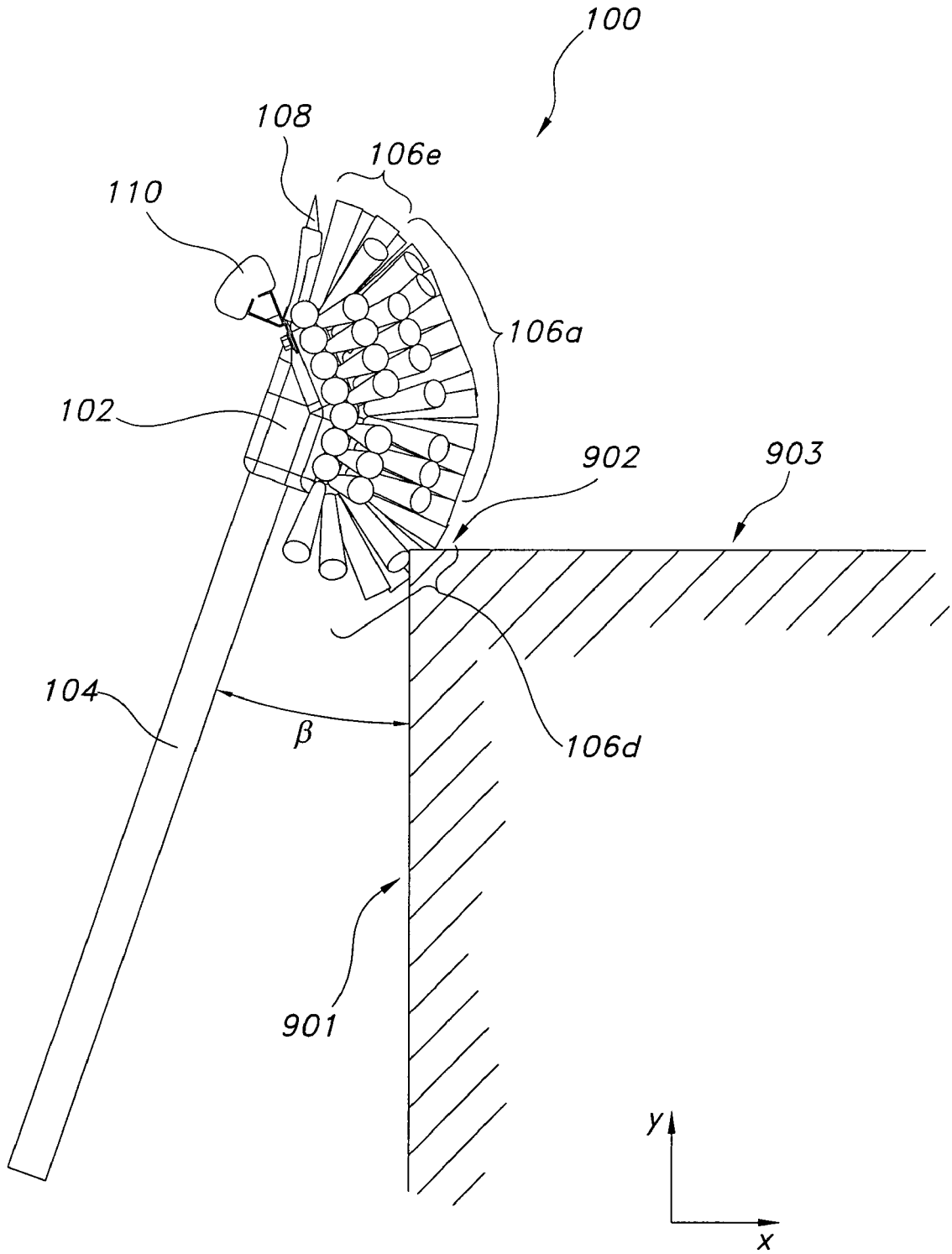
FIG. 9 is a side view of the cleaning device shown in FIGS. 1-7 being used to clean an outside corner of a recreational vehicle, i.e. rolled roof edges and drip rails of the recreational vehicle.

In use, as depicted in FIG. 9, a person may hold the handle 104 and raise and lower the cleaning device 100 in a vertical up and down manner substantially parallel to the y-axis in FIG. 9. When used in such a manner, when brush portion 106*a* approaches an outside corner 902, a person may apply an upward motion to the cleaning device 100 by handle 104 such that support 102 may be positioned above a vertical surface 901 along the y-axis to be cleaned. A portion of a horizontal surface 903 substantially parallel to the x-axis that intersects the vertical surface 901 may be cleaned using brush portion 106*d* such as by downward motion of the cleaning device 100. Thus, the angle β between handle 104 and brush portion 106*d* allows the brushes 106*d* to be used for cleaning around outside corners 902 that may be rounded or flat. The angle β between the handle 104 and brush portion 106*d* is particularly beneficial for roof corners on motor homes, recreational vehicles (RV's), and the like, such that a portion of the roof may be cleaned without scratching or damaging the surfaces.

As further seen in FIGS. 1-2 and 4-6, the cleaning device 100 may include brush portion 106*e* coupled to an edge surface of support 102. Brush portion 106*e* has bristles that extend proximally from the handle 104 in a direction generally parallel to the handle axis A. Brush portion 106*e* may be adjacent brush portion 106*a* and the squeegee 108. As best shown in FIGS. 1, 4-6, a plane of brush portion 106*e* represented by dashed line 3 extends in a direction substantially parallel to the longitudinal axis/plane represented by dashed line 2 of the squeegee 108, which extends along a contact edge 108*a* of the squeegee 108. Brush portion 106*e* has a length that may be about ¼ inch below the contact edge 108*a* shown in FIG. 1 of the squeegee 108 which may allow the squeegee 108 to dry a surface without the surface being re-wet by brush portion 106*e*.

The contact edge 108*a* of squeegee 108 may be rubberized for wiping and/or drying a surface without scratching the surface. The squeegee 108 may also include a substantially inelastic portion 108*b* (best shown in FIG. 4) having one end coupled to the support 102 and an opposite end integral with the contact edge 108*a*. The substantially inelastic portion 108*b* has a mechanical strength that may allow a large amount of force to be applied to the inelastic portion 108*b* without distorting the squeegee 108. Thus, it is contemplated that the substantially inelastic portion 108*b* of squeegee 108 may be heat treated or manufactured in any method known by one of skill in the art in order to obtain a desired angle α (described below) between the squeegee 108 and the scrubber 110.

As illustrated in FIGS. 1, 4-6 and 7, scrubber 110 may include a sponge 110*a* that may be coupled to a V-clamp 110*b*. The scrubber 110 may further include a mesh 110*c* (best seen in FIG. 1) coupled to the outer surface of the sponge 110*a* that may be used to scrub dirt, bugs, etc. from a surface. The mesh 110*c* may be made from various materials such as cotton or polyester. Other materials known by one of ordinary skill in the art may also be used to manufacture the mesh 110*c*. In an alternative embodiment, a scrubbing material other than a mesh may be used.

The scrubber 110 may be coupled to the second planar surface 122 of support 102 (as best seen in FIG. 4). As described above, the first planar surface 121 and the second planar surface 122 may be angled with respect to each other between a range that may be about 90° or greater. In an exemplary embodiment shown in FIG. 1, the angle μ between the first planar surface 121 and the second planar 122 may be greater than 90° such that angle μ may be obtuse. Thus, when the scrubber 110 is coupled to the second planar surface 122, the angle μ between the scrubber 110 and the first planar surface 121 may be obtuse. In an alternative embodiment shown in FIGS. 4-6, angle μ may be defined by the angle between axis 4 and handle axis A.

As depicted in FIG. 7, the scrubber 110 may be coupled to the second planar surface 122 of the support 102 by screws 110*d*. Screws 110*d* may be used to secure the scrubber 110 the support by inserting screws 110*d* through a flange 110*e* on the V-clamp 110*b*. The V-clamp 110*b* may be made of a high strength metal or plastic that can handle the forces of scrubbing windshields/windows, painted surfaces, etc.

The scrubber 110 may be coupled to the support 102 such that the scrubber 110 may be adjacent the squeegee 108 at an angle α relative to the squeegee 108. The angle α between the scrubber 110 and squeegee 108 may be an acute angle selected in a range of about 30° to about 60°. In an exemplary embodiment, the angle α between the scrubber 110 and the squeegee 108 may be about 45°. Selecting an angle from a range of angles of about 30° to about 60 may allow the squeegee 108 to be used without interference by the scrubber 110 or vice versa. For example, as illustrated in FIG. 5, the scrubber 110 may contact a surface being cleaned such that the contact edge 108*a* of the squeegee 108 does not also contact the surface at the same time.

As shown in FIG. 3 the cleaning device 100 may be used to clean near an inside corner 175. While a first surface 170 is in contact and being cleaned by brush portion 106*a*, a second surface 180 may also contact and may be cleaned by brush portion 106*c*. Brush portion 106*c* may extend away from the side surface 131 of the support 102 and a side edge 107*b* of the squeegee 108. As shown in FIG. 3, the brush portion 106*c* may be between vertical surface 180 and side surface 131. When brush portion 106*c* may be between vertical surface 180 and side surface 131, brush portion 106*c* may act as a buffer so that scratches and damage may be prevented on the vertical surface 180 which may be caused by side surface 131.

In an exemplary embodiment, after the first surface 170 and second surface 180 have been cleaned, a user may rotate the cleaning device 100 using handle 104 to orient the side surface 131 of the support 102 and brush portion 106*c* towards the inside corner 175. Thus, cleaning device 100 may be positioned to clean the inside corner 175.

Figure 6:
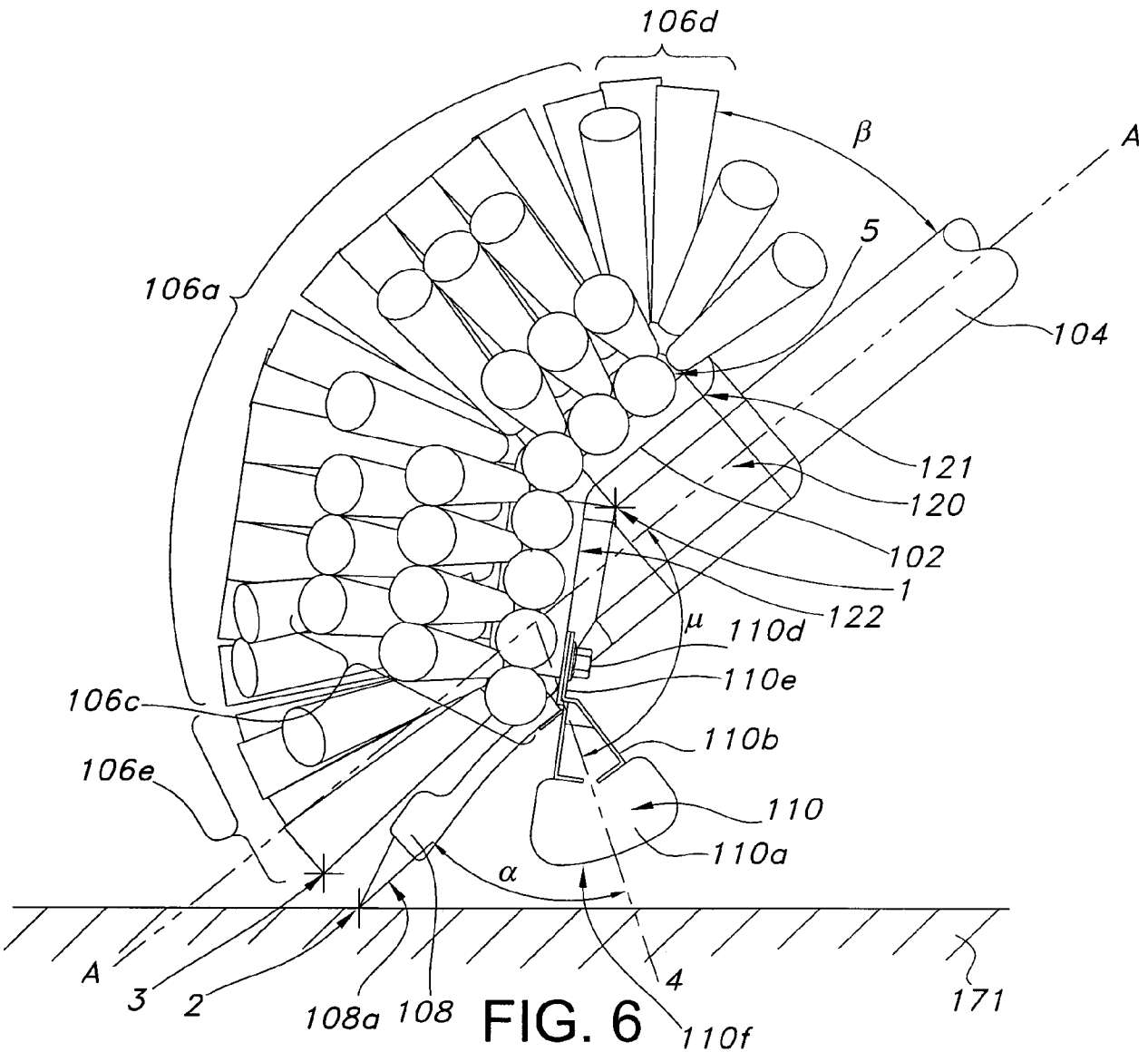
FIG. 6 is another side view of the cleaning device illustrated in FIG. 1 showing a squeegee on a surface.

FIGS. 4-6 depict side views of a cleaning device 100 being used on surface 171. As in FIG. 4, the support 102 may be angled such that brush portion 106*a* may be used to clean surface 171. In the orientation shown in FIG. 4, when brush portion 106*a* contacts surface 171, the squeegee 108 and scrubber 110 are oriented away from the surface 171. Then in FIG. 5, when the cleaning device 100 is rotated 180° via handle 104, the scrubber 110 is oriented towards surface 171 and brush portion 106*a* does not contact surface 171. The scrubber 110 may then be used to scrub the surface 171 without interference from brush portions 106*a*, 106*b*, 106*c*, 106*d*, 106*e* or the squeegee 108. In yet another use shown in FIG. 6, the handle 104 of the cleaning device 100 may be angled with respect to the surface 171 such that the handle 104 is not parallel the surface 171. In the position illustrated in FIG. 6, the squeegee 108 may be used without interference from brush portions 106*a*, 106*b*, 106*c*, 106*d*, 106*e* and the scrubber 110.

FIG. 7 shows an exploded view of the components of the cleaning device 100. As illustrated in FIG. 7, the squeegee 108 may be coupled to support 102 via screws 108*c* at an angle with respect to the scrubber 110. The scrubber 110 may be coupled to the second planar surface 122 of the support 102 via screws 110*d*. A handle 104 may be inserted into a recess 120*a* and secured in the handle support 120 on the support 102. In an exemplary embodiment, the handle 104 which may be coupled to the support 102 may be a telescoping handle 104 that can extend or retract in length. The telescoping handle 104 may allow the cleaning device 100 to reach surfaces beyond the normal reach of an person. In addition, the handle 104 may include a grip portion (not shown) for greater handling capabilities and may have padded portions along the length of the handle 104 to prevent scratches or damage to objects that may unintentionally contact the handle 104 during use of the cleaning device 100.

In an alternative embodiment, the cleaning device 100 may include a sprayer (not shown) that sprays liquid such as water from the device 100. The sprayer may include an attachable hose or a channel within the support 102 to allow liquid to be sprayed from the cleaning device 100.

FIG. 8 depicts a cleaning device 100 in use with a slide out room of a recreational vehicle (RV). The cleaning device 100 may be oriented such that brush portion 106*a* contacts a surface 801 of the RV, and brush portion 106*c* contacts a second surface 802 of the RV. Brush portion 106*a* and brush portion 106*c* may prevent damage to the surfaces 801, 802 of the RV by preventing the side surfaces 130, 131 of the support 102 and the side edges 107*a*, 107*b* of the squeegee 108 from contacting the surfaces 801, 802 of the RV.

Although the present invention has been particularly described in conjunction with specific embodiments, it is evident that many alternatives, modifications, and variations will be apparent to those skilled in the art. It is therefore contemplated that the appended claims will embrace any such alternatives, modifications, and variations as falling within the true scope and spirit of the present invention.

What is claimed:

1. A multifunction cleaning device configured to scrub, brush, and squeegee a surface, the device comprising:

an elongate handle having a handle axis oriented along a plane;

an elongated support disposed at an end of said handle and disposed transverse with respect to the handle axis;

a brush coupled to said support, said brush comprising a first plurality of bristles extending from a first side of said support and positioned on a side of the plane, said brush further comprising a second plurality of bristles extending from a leading edge of said support with the second plurality of bristles extending from the support in a direction generally parallel to the handle axis and angled with respect to the first plurality of bristles;

a squeegee coupled to the second side of said support, said squeegee having a contact edge positioned on an opposite side of the plane, said squeegee being fixed to extend along a squeegee axis in a direction substantially parallel to the second plurality of bristles, the contact edge of the squeegee extending beyond the free ends of the second plurality of bristles in the direction of the handle axis; and a scrubber coupled to said second side of said support between the squeegee and the handle and disposed on the opposite side of the plane, the scrubber having a scrubber axis defining an acute angle a between it and the squeegee axis, the scrubber axis further defining an obtuse angle μ between it and the handle axis.

2. The device of claim 1, wherein the brush further comprises bristles extending sidewardly from said handle in a direction generally parallel to the plane.

3. The device of claim 1, wherein the brush further comprises bristles oriented distally at an angle β with respect to the axis of the handle.

4. The device of claim 3, wherein said angle β is an acute angle.

5. The device of claim 1, wherein the handle is extendable and retractable in length.

6. The device of claim 1, wherein the contact edge of said squeegee extends proximally about ¼ inch beyond the free ends of the second plurality of bristles in the direction of said handle axis.

7. The device of claim 1, wherein the scrubber is fixedly coupled to the handle.

8. The device of claim 1, wherein the scrubber is positioned entirely on the opposite side of the plane.

* * * * *